US009855757B2

(12) United States Patent
Ono et al.

(10) Patent No.: US 9,855,757 B2
(45) Date of Patent: Jan. 2, 2018

(54) LIQUID CARTRIDGE PROVIDED WITH CARTRIDGE BODY AND STORAGE ELEMENT FIXED THERETO BY ADHESIVE AGENT AND METHOD FOR MANUFACTURING THE SAME

(71) Applicant: BROTHER KOGYO KABUSHIKI KAISHA, Nagoya-shi, Aichi-ken (JP)

(72) Inventors: Akihito Ono, Nagoya (JP); Naoya Okazaki, Gifu-ken (JP)

(73) Assignee: BROTHER KOGYO KABUSHIKI KAISHA, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/235,447

(22) Filed: Aug. 12, 2016

(65) Prior Publication Data

US 2017/0066249 A1 Mar. 9, 2017

(30) Foreign Application Priority Data

Sep. 7, 2015 (JP) ..... 2015-176107

(51) Int. Cl.
*B41J 2/175* (2006.01)

(52) U.S. Cl.
CPC ..... *B41J 2/17553* (2013.01); *B41J 2/1752* (2013.01); *B41J 2/1753* (2013.01); *B41J 2/17509* (2013.01); *B41J 2/17513* (2013.01); *B41J 2/17523* (2013.01); *B41J 2/17566* (2013.01); *B41J 2002/17576* (2013.01)

(58) Field of Classification Search
CPC . B41J 2/17559; B41J 2/17503; B41J 2/17553
See application file for complete search history.

(56) References Cited

U.S. PATENT DOCUMENTS

2012/0141692 A1* 6/2012 Sato ..... B41J 2/14 427/561
2014/0292958 A1* 10/2014 Tomoguchi ..... B41J 2/17503 347/86

FOREIGN PATENT DOCUMENTS

JP 2005-138393 A 6/2005
JP 2005138393 A * 6/2005
JP 2006312252 A * 11/2006

* cited by examiner

*Primary Examiner* — Sharon A Polk
(74) *Attorney, Agent, or Firm* — Merchant & Gould P.C.

(57) ABSTRACT

A liquid cartridge includes: a storage element; an adhesive agent; and a cartridge body. The storage element includes: a substrate having a first surface; and a protrusion protruding from the first surface. The cartridge body includes a support portion supporting the storage element. The support portion has: a first support surface in contact with the first surface and supporting the first surface; a second support surface in contact with the first surface and supporting the first surface; and a recessed surface positioned between the first support surface and the second support surface in a first direction. The recessed surface defines a chamber configured to store the adhesive agent to fix the protrusion of the storage element to the recessed surface. The chamber is exposed to an outside through an opening in a second direction perpendicular to the first direction and parallel to the first support surface.

19 Claims, 6 Drawing Sheets

LIQUID CARTRIDGE PROVIDED WITH CARTRIDGE BODY AND STORAGE ELEMENT FIXED THERETO BY ADHESIVE AGENT AND METHOD FOR MANUFACTURING THE SAME

CROSS REFERENCE TO RELATED APPLICATION

This application claims priority from Japanese Patent Application No. 2015-176107 filed Sep. 7, 2015. The entire content of the priority application is incorporated herein by reference.

TECHNICAL FIELD

The present disclosure relates to a liquid cartridge provided with a liquid chamber, and to a method for manufacturing the liquid cartridge.

BACKGROUND

There is a conventional inkjet recording device known in the art that records images on a recording medium by ejecting ink stored in an ink tank through nozzles. The conventional inkjet recording device is configured such that, when ink in an ink cartridge that has been attached to the inkjet recording device has been consumed, a new ink cartridge can be attached to the inkjet recording device in replacement of the used cartridge.

Japanese Patent Application Publication No. 2005-138393 discloses an inkjet recording device provided with an ink tank. The ink tank is provided with a storage element. In order to fix the storage element to the ink tank, several methods are proposed, such as a method of using a fixing pin for force-fitting, a method of using a double-stick tape, a method of using an adhesive agent and the like.

In the method of using an adhesive agent disclosed in the above Publication, guide channels for guiding the adhesive agent are formed in an attachment surface of the ink tank in order to guide flow of the adhesive agent during a process of attaching the storage element to the attachment surface. This configuration allows the adhesive agent to flow along the guide channels, thereby allowing the adhesive agent to be filled in a region of the attachment surface facing a portion of the storage element to be attached to the attachment surface.

SUMMARY

When downsizing an ink cartridge, it is desirable to downsize external dimensions of the ink cartridge without reducing a volume of ink stored in the ink cartridge. In a method for fixing a storage element to an ink cartridge by force-fitting or thermally deforming a pin disposed near the storage element or inserted through the storage element, a pin or force-fitted pin protrudes at a position higher than an outer surface of the storage element. Alternatively, in a method for fixing a storage element to an ink cartridge by using a double-stick tape, a double-stick tape is sandwiched between an attachment surface of the ink cartridge and the storage element. Thus, an outer surface of the storage element in this case is positioned higher than that in a case where a double-stick tape is not used by the thickness of the double-stick tape.

These fixing methods requires a space for fixing the storage element to the attachment surface of the ink cartridge. Therefore, these fixing methods are not suitable for downsizing the ink cartridge.

In the method of using an adhesive agent disclosed in the above publication, the adhesive agent filled in a space between the attachment surface of the ink tank and the storage element has an area exposed to an outside, and this exposed area of the adhesive agent is relatively small. When a photocurable adhesive agent is used, the filled adhesive agent is not easily exposed to light. Further, the space in which the adhesive agent is filled does not have a configuration that allows sufficient air to pass therethrough. Thus, when a drying adhesive agent is used, more time may be required for the adhesive agent to sufficiently cure or insufficient curing may occur.

In view of the foregoing, it is an object of the disclosure to provide a liquid cartridge having a configuration that allows an adhesive agent to cure easily when fixing a storage element to the liquid cartridge by the adhesive agent, and a method for manufacturing the liquid cartridge.

In order to attain the above and other objects, the disclosure provides a liquid cartridge including: a storage element; an adhesive agent; and a cartridge body at which the storage element is disposed. The storage element includes: a substrate having a first surface; and a protrusion protruding from the first surface. The cartridge body includes a support portion supporting the storage element. The support portion has: a first support surface in contact with the first surface and supporting the first surface; a second support surface in contact with the first surface and supporting the first surface; and a recessed surface positioned between the first support surface and the second support surface in a first direction. The recessed surface defines a chamber configured to store the adhesive agent to fix the protrusion of the storage element to the recessed surface. The chamber is exposed to an outside through an opening in a second direction perpendicular to the first direction and parallel to the first support surface.

According to another aspect, the disclosure provides a method for manufacturing a liquid cartridge including: a storage element, a cartridge body, and a photocurable adhesive agent for fixing the storage element to the cartridge body, the storage element including: a substrate having a first surface; and a protrusion protruding from the first surface, the cartridge body including a support portion for supporting the storage element, the support portion having: a first support surface; a second support surface spaced apart from the first support surface in a first direction; a recessed surface positioned between the first support surface and the second support surface in the first direction; and a first wall surface positioned beside the recessed surface in a second direction perpendicular to the first direction and parallel to the first support surface. The method includes: injecting the photocurable adhesive agent onto the recessed surface; placing the storage element on the support portion such that the first surface is in contact with the first support surface and the second support surface, that the protrusion faces the recessed surface, a space being defined by the recessed surface, the first surface, and the protrusion, the space having an open end in the second direction opened at the first wall surface, and that the photocurable adhesive agent is provided in the space; and exposing the photocurable adhesive agent provided in the space to light in the second direction through the open end.

According to still another aspect, the disclosure provides a method for manufacturing a liquid cartridge including:

preparing a storage element and a cartridge body, the storage element including: a substrate having a first surface; and a protrusion protruding from the first surface, the cartridge body including a support portion for supporting the storage element, the support portion having: a first support surface; a second support surface spaced apart from the first support surface in a first direction; a recessed surface positioned between the first support surface and the second support surface in the first direction; and a first wall surface positioned beside the recessed surface in a second direction perpendicular to the first direction and parallel to the first support surface; injecting a photocurable adhesive agent onto the recessed surface; placing the storage element on the support portion such that the first surface is in contact with the first support surface and the second support surface, that the protrusion faces the recessed surface, a space being defined by the recessed surface, the first surface, and the protrusion, the space having an open end in the second direction opened at the first wall surface, and that the photocurable adhesive agent is provided in the space; and exposing the photocurable adhesive agent provided in the space to light in the second direction through the open end.

BRIEF DESCRIPTION OF THE DRAWINGS

The particular features and advantages of the embodiment(s) as well as other objects will become apparent from the following description taken in connection with the accompanying drawings, in which:

FIGS. 3A through 3C are views illustrating an external configuration of an IC board 64 provided at the ink cartridge 30, in which FIG. 3A is a perspective view of the IC board 64 as viewed from above; FIG. 3B is a perspective view of the IC board 64 as viewed from below; and FIG. 3C is a front view of the IC board 64;

FIGS. 4A through 4C are views illustrating a support portion 101 of the ink cartridge 30 to which the IC board 64 is not attached, in which FIG. 4A is a perspective view of the support portion 101; FIG. 4B is a top plan view of the support portion 101, and FIG. 4C is a front view of the support portion 101;

FIGS. 5A through 5C are views illustrating the support portion 101 of the ink cartridge 30 to which the IC board 64 is attached, in which FIG. 5A is a perspective view of the support portion 101; FIG. 5B is a top plan view of the support portion 101; and FIG. 5C is a front view of the support portion 101.

DETAILED DESCRIPTION

Figure 1:
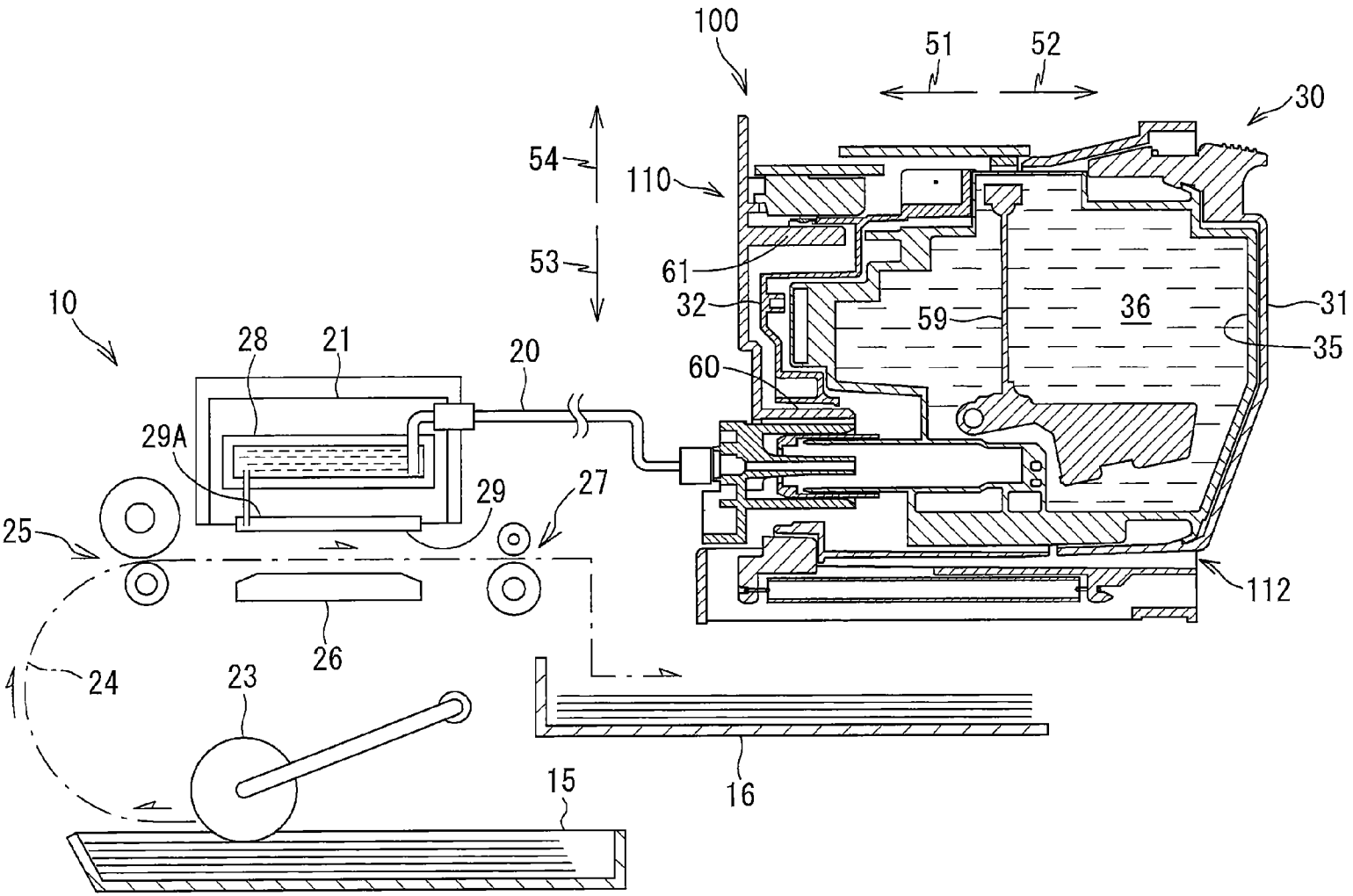
FIG. 1 is a schematic cross-sectional diagram illustrating an internal structure of a printer 10 provided with a cartridge attachment section 110 to which an ink cartridge 30 according to one embodiment is detachably attached.

An ink cartridge 30 as an example of a liquid cartridge according to one embodiment and a printer 10 configured to accommodate the ink cartridge 30 will be described with reference to FIGS. 1 through 6, wherein like parts and components are designated by the same reference numerals to avoid duplicating description.

In the following description, a direction in which the ink cartridge 30 is inserted into a cartridge attachment section 110 is defined as a forward direction 51, and a direction in which the ink cartridge 30 is removed from the cartridge attachment section 110 is defined as a rearward direction 52. The rearward direction 52 is a direction opposite the forward direction 51. The forward direction 51 and the rearward direction 52 are parallel to a horizontal direction in the embodiment, but the forward direction 51 and the rearward direction 52 may not necessarily be parallel to the horizontal direction.

Further, a direction of a gravitational force acting on the ink cartridge 30 is defined as a downward direction 53, and a direction opposite the gravitational direction is defined as an upward direction 54. In the embodiment, the upward direction 54 is a vertically upward direction, while the downward direction 53 is a vertically downward direction.

Further, directions orthogonal to the forward direction 51 and the downward direction 53 are defined as a rightward direction 55 and a leftward direction 56. More specifically, when the ink cartridge 30 has been inserted into an attachment position in the cartridge attachment section 110, i.e., when the ink cartridge 30 is in an attached state (usable or operational state), a direction orienting toward the right is defined as the rightward direction 55, while a direction orienting toward the left is defined as the leftward direction 56 when the ink cartridge 30 is viewed in the rearward direction 52.

Further, directions related to the ink cartridge 30 will be given based on a state of the ink cartridge 30 assuming that the ink cartridge 30 has been inserted into the cartridge attachment section 110, that is, the ink cartridge 30 is in its attached state.

Further, the forward direction 51 and the rearward direction 52 will also be collectively referred to as a front-rear direction 81, the rightward direction 55 and the leftward direction 56 will also be collectively referred to as a left-right direction 82, and the downward direction 53 and the upward direction 54 will also be collectively referred to as a vertical direction 83. The front-rear direction 81 is an example of a first direction, the left-right direction 82 is an example of a second direction, and the vertical direction 83, more specifically, the upward direction 54 is an example of a third direction.

<Overall Structure of Printer 10>

The printer 10 is configured to selectively eject ink droplets onto recording sheets to record images thereon based on an inkjet recording method. As illustrated in FIG. 1, the printer 10 includes a recording head 21, an ink supply device 100, and ink tubes 20 connecting the recording head 21 to the ink supply device 100. The ink supply device 100 includes a cartridge attachment section 110. A plurality of ink cartridges 30 is attachable to and detachable from the cartridge attachment section 110. The ink cartridge 30 is an example of a liquid cartridge. The cartridge attachment section 110 has one surface in which an opening 112 is formed. The ink cartridges 30 can be inserted into the cartridge attachment section 110 through the opening 112 in the forward direction 51, or can be removed from the cartridge attachment section 110 through the opening 112 in the rearward direction 52.

In the embodiment, four ink cartridges 30 corresponding to respective colors of cyan, magenta, yellow, and black can be accommodated in the cartridge attachment section 110 of the ink supply device 100. For an explanatory purpose, in the following description and in the drawings, only one ink cartridge 30 is assumed to be attached to the cartridge attachment section 110 wherever necessary.

The ink cartridge 30 stores ink that can be used in the printer 10. When the ink cartridge 30 is completely attached to the cartridge attachment section 110, the ink cartridge 30 and the recording head 21 are connected by corresponding one of the ink tubes 20. The recording head 21 is provided with a plurality of (four in the embodiment) sub-tanks 28 corresponding to the plurality of ink cartridges 30. Each sub-tank 28 is configured to temporarily store the ink supplied from the corresponding ink cartridge 30 through the corresponding ink tube 20. The recording head 21 is configured to selectively eject the ink supplied from the respective sub-tanks 28 through nozzles 29 according to an inkjet recording method. More specifically, the recording head 21 is provided with a head control board (not illustrated), and piezoelectric elements 29A corresponding one-on-one to the nozzles 29. The head control board selectively applies drive voltages to the piezoelectric elements 29A to eject ink selectively from the nozzles 29.

The printer 10 includes a sheet feeding tray 15, a sheet feeding roller 23, a pair of conveying rollers 25, a platen 26, a pair of discharge rollers 27, and a sheet discharge tray 16. The sheet feeding roller 23 feeds recording sheets from the sheet feeding tray 15 onto a conveying path 24, and the conveying rollers 25 convey the recording sheets over the platen 26. The recording head 21 selectively ejects ink onto the recording sheets as the recording sheets pass over the platen 26, whereby images are recorded on the recording sheets. The discharge rollers 27 receive the recording sheets that have passed over the platen 26 and discharge the recoding sheets onto the sheet discharge tray 16 provided at a position most downstream in the conveying path 24.

<Ink Supply Device 100>

As illustrated in FIG. 1, the ink supply device 100 is provided in the printer 10. The ink supply device 100 is configured to supply ink to the recording head 21 provided in the printer 10. The ink supply device 100 includes the cartridge attachment section 110 to which the ink cartridges 30 can be detachably attached. Incidentally, FIG. 1 illustrates a state where the ink cartridge 30 has been completely attached to the cartridge attachment section 110. In other words, the attached state of the ink cartridge 30 is illustrated in FIG. 1.

<Ink Cartridge 30>

Figure 2:
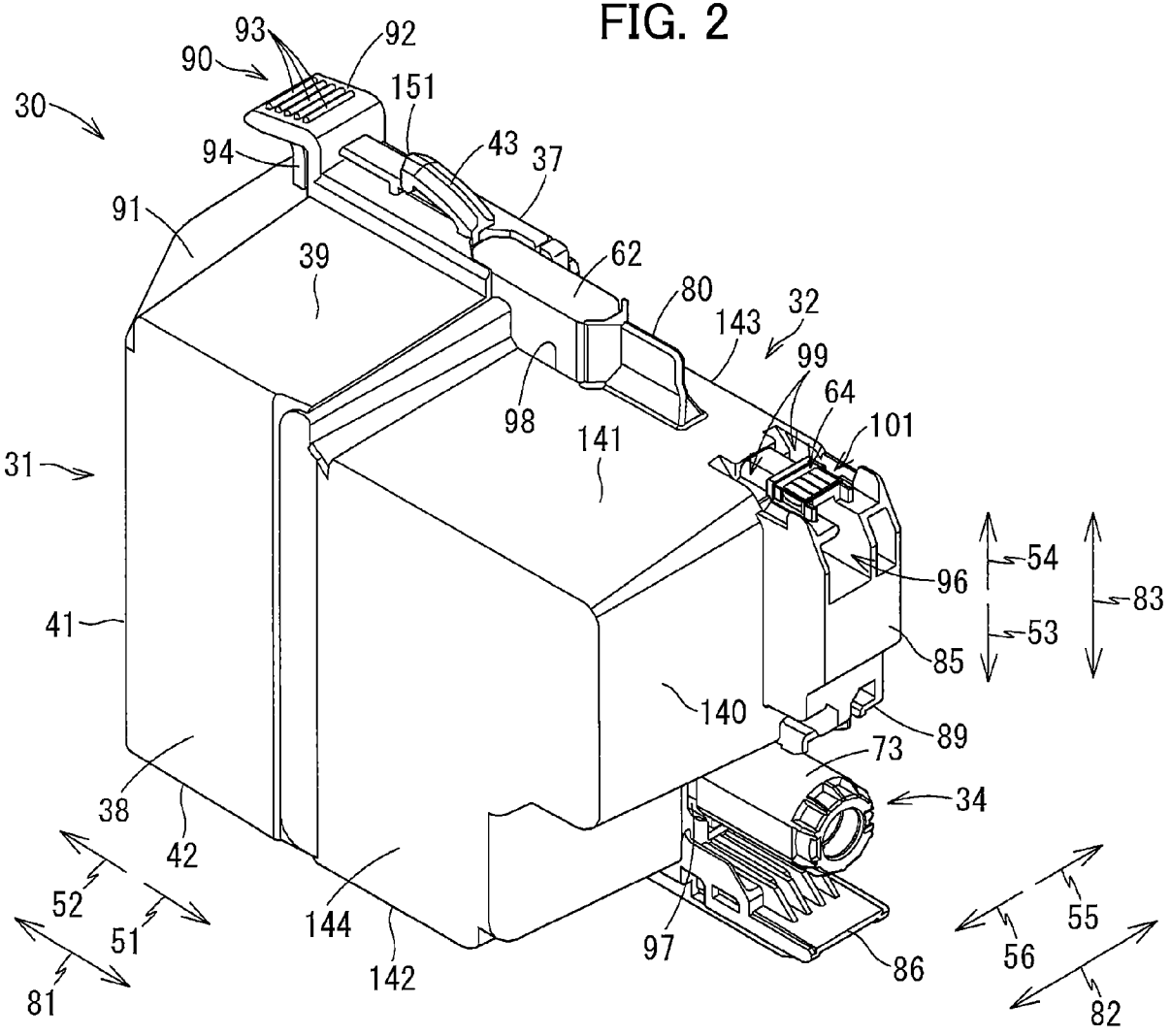
FIG. 2 is a perspective view illustrating an external configuration of the ink cartridge 30.

As illustrated in FIGS. 1 and 2, the ink cartridge 30 is a container that stores ink therein. The ink cartridge 30 has an internal space serving as an ink chamber 36 for storing ink therein. The ink cartridge 30 includes a rear cover 31, a front cover 32, and an inner frame 35. The rear cover 31 and the front cover 32 provide an external shape of the ink cartridge 30. The inner frame 35 is accommodated in the rear cover 31 and the front cover 32. The ink chamber 36 is defined by the inner frame 35. A combination of the rear cover 31 and the front cover 32 is an example of a cartridge body. Ink is an example of liquid.

As illustrated in FIGS. 1 and 2, the ink cartridge 30 is configured of the rear cover 31 having an external shape similar to a rectangular parallelepiped, the front cover 32 including a front wall 140, and the inner frame 35 defining the ink chamber 36. By assembling the front cover 32 to the rear cover 31, the external shape of the ink cartridge 30 is provided. The inner frame 35 is accommodated in the rear cover 31 and the front cover 32 in a state where the front cover 32 and the rear cover 31 are assembled. The ink cartridge 30 has a shape such that a dimension of the ink cartridge 30 in the front-rear direction 81 is slightly greater than a dimension of the ink cartridge 30 in the left-right direction 82 and that a dimension of the ink cartridge 30 in the vertical direction 83 is substantially equal to the dimension of the ink cartridge 30 in the left-right direction 82. A wall of the front cover 32 positioned forward in the forward direction 51 is the front wall 140, while a wall of the rear cover 31 positioned rearward in the rearward direction 52 is a rear wall 41. The rear wall 41 of the rear cover 31 is positioned opposite the front wall 140 of the front cover 32 with respect to the ink chamber 36. In other words, the ink chamber 36 is disposed between the rear wall 41 of the rear cover 31 and the front wall 140 of the front cover 32.

<Rear Cover 31>

The rear cover 31 has a generally box shape with an opening in the forward direction 51. In other words, the rear cover 31 has a front opening. In addition to the rear wall 41, the rear cover 31 includes a right side wall 37 and a left side wall 38 spaced apart from each other in the left-right direction 82, a top wall 39 facing in the upward direction 54, and a bottom wall 42 facing in the downward direction 53. The right side wall 37, the left side wall 38, the top wall 39 and the bottom wall 42 extend in the forward direction 51 from the rear wall 41. The inner frame 35 is inserted into the rear cover 31 through the front opening formed in the rear cover 31. In other words, the rear cover 31 covers a rear portion of the inner frame 35. In a state where the inner frame 35 is inserted into the rear cover 31, the ink chamber 36 is disposed between the bottom wall 42 and the top wall 39.

A protruding portion 43 is provided on the top wall 39 of the rear cover 31. The protruding portion 43 is disposed at a right portion of the top wall 39 in the left-right direction 82 and extends in the front-rear direction 81. The protruding portion 43 has a surface facing in the rearward direction 52, and the surface of the protruding portion 43 serves as a locking surface 151. The locking surface 151 extends in the vertical direction 83. The locking surface 151 faces in the rearward direction 52 and is thus capable of contacting a lock portion (not illustrated) of the cartridge attachment section 110 rearward in the rearward direction 52 when the ink cartridge 30 has been attached to the cartridge attachment section 110. Since the locking surface 151 contacts the lock portion rearward in the rearward direction 52 when the ink cartridge 30 has been attached to the cartridge attachment section 110, the ink cartridge 30 is retained in the cartridge attachment section 110 against a biasing force applied to the ink cartridge 30 from a spring (not illustrated).

An operation portion 90 is also provided on the top wall 39 of the rear cover 31 at a position rearward in the rearward direction 52 relative to the locking surface 151. The top wall 39 of the rear cover 31 includes a sub-top wall 91 at a rear end portion thereof. The sub-top wall 91 is positioned downward in the downward direction 53 relative to a remaining portion of the top wall 39. The operation portion 90 is disposed above a right portion of the sub-top wall 91 with a space therebetween. The operation portion 90 has a generally plate shape that protrudes from a position rearward in the rearward direction 52 relative to the protruding portion 43 and near the boundary between the sub-top wall 91 and the remaining portion of the top wall 39 to a position higher than the protruding portion 43 in the upward direction 54 and then bends diagonally in the rearward direction 52 and the downward direction 53. A rib 94 is provided at a position between the operation portion 90 and the sub-top wall 91. The rib 94 is connected to the operation portion 90 and the sub-top wall 91, and extends in the rearward direction 52. A dimension of the rib 94 in the left-right direction 82 is smaller than a dimension of the operation portion 90 in the left-right direction 82.

The operation portion 90 has a surface facing in the upward direction 54 and the rearward direction 52, and the surface of the operation portion 90 serves as an operating surface 92. A position of the operating surface 92 in the front-rear direction 81 overlaps a position of the sub-top wall 91 in the front-rear direction 81. In other words, when the ink cartridge 30 is viewed in the downward direction 53, the operating surface 92 and the sub-top wall 91 overlap each other. The operating surface 92 is provided with a plurality of protrusions 93. The plurality of protrusions 93 extends in the left-right direction 82 and arranged at intervals in the front-rear direction 81. The plurality of protrusions 93 facilitates user's recognition of the operating surface 92 as well as prevents user's finger from slipping over the operating surface 92 when the user operates the operation portion 90 with his/her fingers.

The operating surface 92 can be visually recognized when the ink cartridge 30 is viewed in the downward direction 53. The operating surface 92 can also be visually recognized when the ink cartridge 30 is viewed in the forward direction 51. In other words, the operating surface 92 can be visually recognized when the ink cartridge 30 is viewed in a direction from the top wall 39 to the bottom wall 42 and when the ink cartridge 30 is viewed in a direction from the rear wall 41 to the front wall 140. The user operates the operating surface 92 when removing, from the cartridge attachment section 110, the ink cartridge 30 that has been attached to the cartridge attachment section 110.

<Front Cover 32>

The front cover 32 has a generally box shape with an opening in the rearward direction 52. In other words, the front cover 32 has a rear opening. In addition to the front wall 140, the front cover 32 includes a right side wall 143 and a left side wall 144 spaced apart from each other in the left-right direction 82, and a top wall 141 and a bottom wall 142 spaced apart from each other in the vertical direction 83. The right side wall 143, the left side wall 144, the top wall 141 and the bottom wall 142 extend in the rearward direction 52 from the front wall 140. The inner frame 35 is inserted into the front cover 32 through the rear opening formed in the front cover 32. In other words, the front cover 32 covers a front portion of the inner frame 35, i.e., a portion of the inner frame 35 not covered by the rear cover 31.

In a state where the front cover 32 is attached to the rear cover 31, that is, in a state where the ink cartridge 30 is assembled, the top wall 141 of the front cover 32 and the top wall 39 of the rear cover 31 constitute a top wall of the ink cartridge 30, the bottom wall 142 of the front cover 32 and the bottom wall 42 of the rear cover 31 constitute a bottom wall of the ink cartridge 30, the right side wall 143 of the front cover 32 and the right side wall 37 of the rear cover 31 constitute a right side wall of the ink cartridge 30, and the left side wall 144 of the front cover 32 and the left side wall 38 of the rear cover 31 constitute a left side wall of the ink cartridge 30. Further, in a state where the ink cartridge 30 is assembled, the front wall 140 of the front cover 32 constituting a front wall of the ink cartridge 30 is spaced apart from the rear wall 41 of the rear cover 31 constituting a rear wall of the ink cartridge 30 in the front-rear direction 81.

A depressed portion 96 is formed in the front wall 140 of the front cover 32 at an upper right portion thereof. The depressed portion 96 is depressed from the front wall 140 in the rearward direction 52. A rod 61 (FIG. 1) provided in the cartridge attachment section 110 is inserted into the depressed portion 96 when the ink cartridge 30 is attached to the cartridge attachment section 110. Accordingly, the depressed portion 96 has a shape in cross-section perpendicular to the left-right direction 82, the shape of the depressed portion 96 conforming to a shape of the rod 61 in cross-section perpendicular to the left-right direction 82. The depressed portion 96 extends from the front wall 140 in the rearward direction 52.

Depressed portions 99 are formed in the top wall 141 of the front cover 32 at positions rearward in the rearward direction 52 relative to an IC board 64 (FIG. 2, described later). The depressed portions 99 are depressed from the top wall 141 in the downward direction 53. One of the depressed portions 99 extends in the rightward direction 55 to a position farther than a right end of the IC board 64 in the rightward direction 55, while the other of the depressed portions 99 extends in the leftward direction 56 to a position farther than a left end of the IC board 64 in the leftward direction 56. The IC board 64 will be described later in detail.

A hole 97 is formed in the front wall 140 of the front cover 32 at a lower right portion thereof. The hole 97 penetrates the front wall 140 in the front-rear direction 81. In a state where the inner frame 35 is inserted into the front cover 32, the hole 97 allows an ink supply portion 34 (FIG. 2, described later) of the inner frame 35 to be exposed to an outside of the front cover 32 therethrough. Accordingly, the hole 97 is provided at a position conforming to a position of the ink supply portion 34 of the inner frame 35, and has a size and a shape conforming to a size and a shape of the ink supply portion 34. The ink supply portion 34 will be described later in detail.

A first protruding portion 85 and a second protruding portion 86 are provided on the front wall 140 of the front cover 32.

The first protruding portion 85 protrudes in the forward direction 51 at an upper right portion of the front cover 32. The depressed portion 96 is formed at a protruding end (i.e. front end) of the first protruding portion 85. The protruding end of the first protruding portion 85 constitutes a part of the front wall 140. The first protruding portion 85 has a lower surface 89 positioned between the IC board 64 and the ink supply portion 34 in the vertical direction 83. When the ink cartridge 30 has been attached to the cartridge attachment section 110, the lower surface 89 contacts an upper surface of a positioning member 60 (FIG. 1) of the cartridge attachment section 110.

A notch 115 (FIG. 4A) is formed in an end portion of the first protruding portion 85 in the rightward direction 55 (i.e. right end portion of the first protruding portion 85) at its upper end. A notch 116 (FIG. 4A) is formed in an end portion of the first protruding portion 85 in the leftward direction 56 (i.e. left end portion of the first protruding portion 85) at its upper end. The notch 115 and the notch 116 are formed in regions of the end portions of the first protruding portion 85 overlapping an opening 108 (FIG. 4A) and an opening 109 (FIG. 4A) formed in a support portion 101, respectively, when viewed in the left-right direction 82. Here, the term "overlap" means that, when viewed in the left-right direction 82, at least a part of the opening 108 and at least a part of the opening 109, preferably the opening 108 in its entirety and the opening 109 in its entirety, are positioned within the notch 115 and the notch 116, respectively. With this configuration, the opening 108 and the opening 109 are exposed to an outside of the first protruding portion 85 through the notch 115 and the notch 116, respectively.

The second protruding portion 86 protrudes in the forward direction 51 from the front wall 140 of the front cover 32 at a lower portion thereof. In other words, the second protruding portion 86 protrudes from the front wall 140 at a position downward in the downward direction 53 relative to the ink supply portion 34.

A hole 98 is formed in the top wall 141 of the front cover 32. The hole 98 penetrates the top wall 141 in the vertical direction 83. In a state where the inner frame 35 is inserted into the front cover 32, the hole 98 allows a detection portion 62 (FIG. 2, described later) of the inner frame 35 to be exposed to an outside of the front cover 32 therethrough. Accordingly, the hole 98 is provided at a position conforming to a position of the detection portion 62 of the inner frame 35, and has a size and a shape conforming to a size and a shape of the detection portion 62. The detection portion 62 will be described later in detail.

<Ink Supply Portion 34>

The inner frame 35 is provided with the ink supply portion 34 that protrudes further forward in the forward direction 51 relative to the front wall 140. The ink supply portion 34 is an example of a liquid supply portion. The ink supply portion 34 extends in the front-rear direction 81. The ink supply portion 34 includes a cylindrical wall 73. The cylindrical wall 73 has a hollow cylindrical shape with an interior space formed therein. The cylindrical wall 73 extends from an interior of the ink chamber 36 to an exterior of the ink chamber 36. The cylindrical wall 73 has an end in the rearward direction 52 (i.e. rear end) that opens in the ink chamber 36. The cylindrical wall 73 has an end in the forward direction 51 (i.e. front end) that opens to an exterior of the ink cartridge 30. With this configuration, the cylindrical wall 73 is in communication with the ink chamber 36 and the exterior of the ink cartridge 30 through the interior space of the cylindrical wall 73. In other words, the cylindrical wall 73 is configured to supply ink stored in the ink chamber 36 to the exterior of the ink cartridge 30 through the interior space of the cylindrical wall 73.

Incidentally, in the embodiment, the ink supply portion 34 protrudes further forward in the forward direction 51 relative to the front wall 140 of the front cover 32 of the ink cartridge 30. However, a hole may be formed in an outer wall of the ink cartridge 30 so that ink stored in the ink cartridge 30 can flow out of the ink cartridge 30 through the hole.

<Detection Portion 62>

The inner frame 35 is also provided with the detection portion 62 that protrudes further outward in the upward direction 54 relative to the top wall 141. The detection portion 62 is a hollow protruding portion with an interior space formed therein. The interior space of the detection portion 62 is in communication with the ink chamber 36. The detection portion 62 allows transmission of light traveling in the left-right direction 82.

A sensor arm 59 (FIG. 1) is provided in the ink chamber 36 of the inner frame 35. A part of the sensor arm 59 is inserted into the interior space of the detection portion 62. The part of the sensor arm 59 disposed in the interior space of the detection portion 62 changes its position according to an amount of ink in the ink chamber 36, which causes change in intensity of light transmitted through the detection portion 62. The amount of ink in the ink chamber 36 can thus be detected based on the change in intensity of light transmitted through the detection portion 62.

<Interposing Wall 80>

An interposing wall 80 is provided on the top wall 141 of the front cover 32 at a position rearward in the rearward direction 52 relative to the IC board 64 and a position forward in the forward direction 51 relative to the hole 98. The interposing wall 80 protrudes in the upward direction 54 from the top wall 141. The interposing wall 80 has a thin, elongated plate shape such that a dimension of the interposing wall 80 in the front-rear direction 81 is greater than a dimension of the interposing wall 80 in left-right direction 82. The interposing wall 80 restricts minute fragments of the IC board 64 generated due to abrasion or wearing from approaching the detection portion 62.

<IC Board 64>

The IC board 64 is provided on the top wall 141 of the front cover 32 at a position upward in the upward direction 54 relative to the first protruding portion 85, that is, a position upward in the upward direction 54 relative to the ink supply portion 34. The IC board 64 is manufactured by chip-on-board (COB), for example. The IC board 64 is an example of a storage element. The IC board 64 stores data indicative of information on the ink cartridge 30 (for example, a lot number and the date of production) as well as information on ink (for example, a color of ink). External access to the IC board 64 enables the data stored in the IC board 64 to be retrieved therefrom. The IC board 64 is attached to the support portion 101. The support portion 101 will be described later in detail.

Figure 3A:
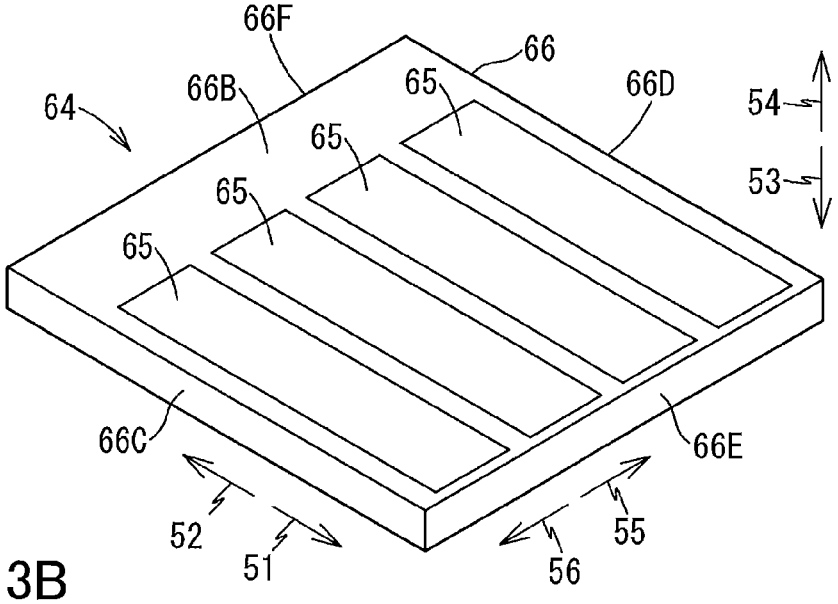
Figure 3B:
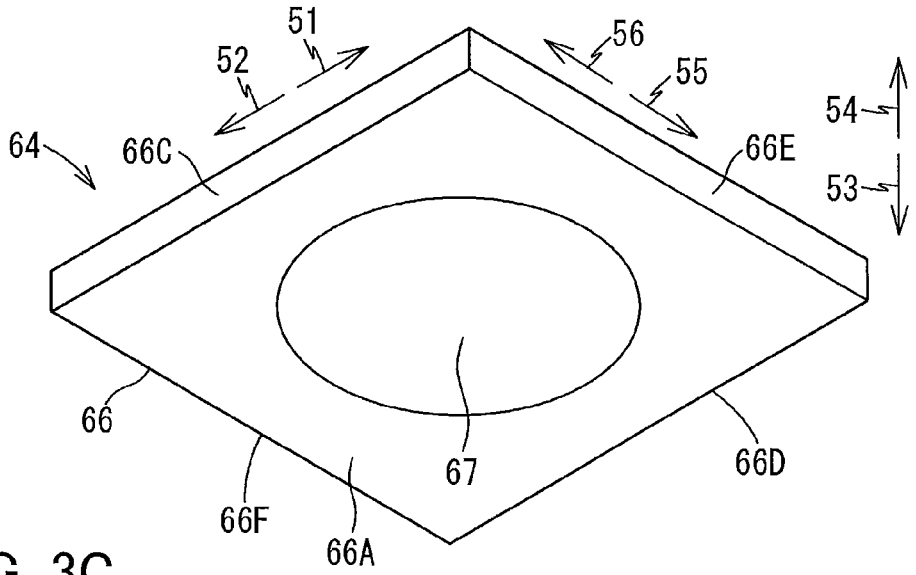
Figure 3C:
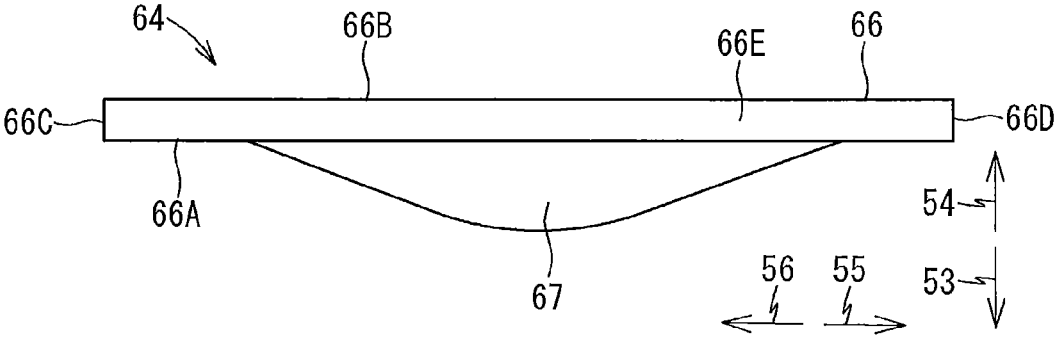

As illustrated in FIGS. 3A through 3C, the IC board 64 has a rectangular shaped plate portion 66. The plate portion 66 is an example of a substrate. The plate portion 66 has a bottom surface serving as a first surface 66A and a top surface serving as a second surface 66B. Further, the plate portion 66 has a left end surface 66C, a right end surface 66D, a front end surface 66E, and a rear end surface 66F. The right end surface 66D is an example of a first end surface, the left end surface 66C is an example of a second end surface, the front end surface 66E is an example of a third end surface, and the rear end surface 66F is an example of a fourth end surface.

A bare chip is mounted on the first surface 66A and connected to the first surface 66A by wire bonding (not illustrated). The bare chip and wires are covered with an epoxy resin by molding. By molding of epoxy resin, a protrusion 67 is formed on the first surface 66A. In other words, at least an outer surface portion of the protrusion 67 is formed of an epoxy resin. The protrusion 67 protrudes from the first surface 66A.

Four electrodes 65 are provided at the second surface 66B of the plate portion 66. The electrodes 65 are an example of a plurality of electrical contacts. Each of the electrodes 65 are electrically connected to the bare chip. The electrodes 65 extend in the front-rear direction 81 and are arranged in separation from one another in the left-right direction 82. The electrodes 65 are exposed to an outside through the second surface 66B of the plate portion 66, thereby allowing external electrical access to the electrodes 65.

When the ink cartridge 30 has been attached to the cartridge attachment section 110, the four electrodes 65 of the IC board 64 are electrically connected to four electrical contacts (not illustrated) provided at an inner top surface of the cartridge attachment section 110, respectively.

Each of the four electrical contacts provided at the cartridge attachment section 110 is electrically connected to an arithmetic device through electrical circuits. The arithmetic device may be configured of a CPU, a ROM, a RAM, and the like. The arithmetic device may be configured of a control unit of the printer 10.

<Support Portion 101>

Figure 4A:
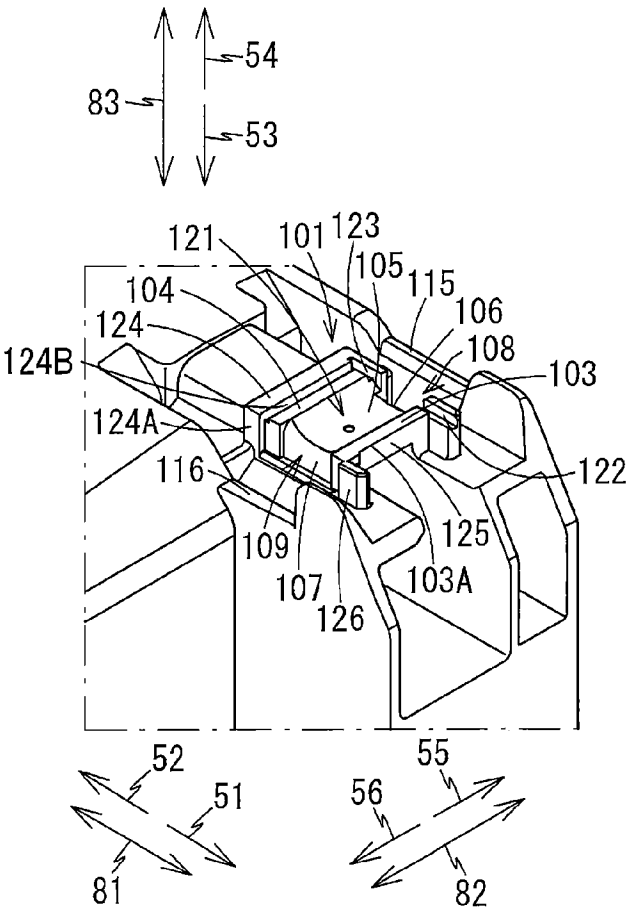
Figure 4B:
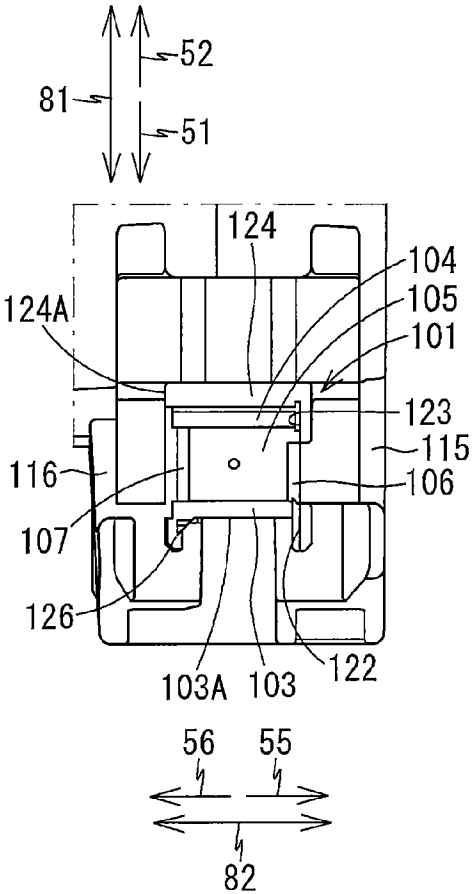
Figure 4C:
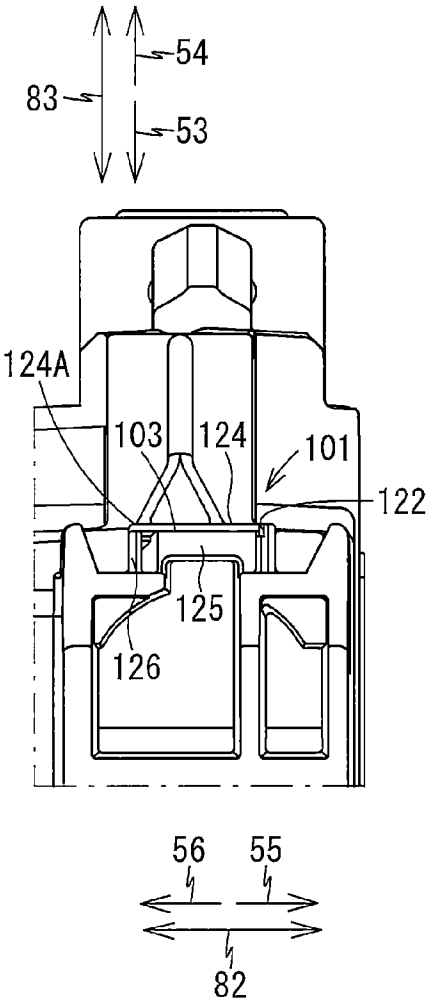
Figure 5A:
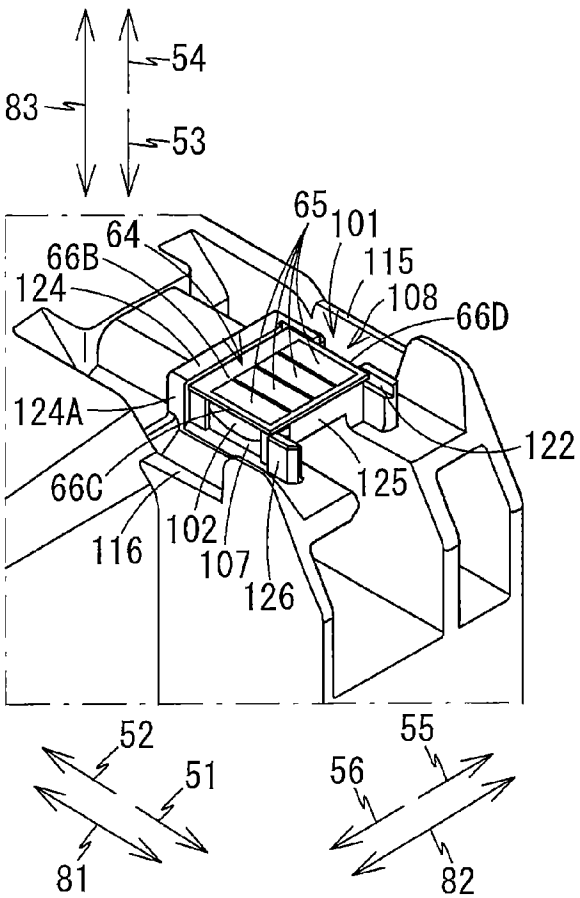

As illustrated in FIGS. 2, 4A and 5A, the ink cartridge 30 includes the support portion 101 to which the IC board 64 is attached. The IC board 64 is fixed to the support portion 101 with an adhesive agent 102 (FIG. 5A). The adhesive agent 102 is an acrylic-type photocurable adhesive agent, for example.

The support portion 101 is provided on the top wall 141 of the front cover 32 at a position upward in the upward direction 54 relative to the first protruding portion 85, that is, a position upward in the upward direction 54 relative to the ink supply portion 34.

The support portion 101 includes a first support surface 103, a second support surface 104, a recessed surface 105, a right wall surface 106, and a left wall surface 107. The right wall surface 106 and the left wall surface 107 are an example of a first wall surface.

The first support surface 103 and the second support surface 104 are surfaces facing in the upward direction 54 and lying in an imaginary plane extending in the front-rear direction 81 and the left-right direction 82. In other words, the first support surface 103 and the second support surface 104 are arranged so as to be in flush with each other. The first support surface 103 is positioned spaced apart from the second support surface 104 in the forward direction 51. That is, the first support surface 103 is positioned forward in the forward direction 51 relative to the second support surface 104. The first support surface 103 and the second support surface 104 are each formed in a rectangular shape having two sides extending in the front-rear direction 81 and two sides extending in the left-right direction 82.

The recessed surface 105 is positioned between the first support surface 103 and the second support surface 104 in the front-rear direction 81. One of the two sides of the first support surface 103 extending in the left-right direction 82 and positioned closer to the second support surface 104 than the other to the second support surface 104 (i.e. a rear edge of the first support surface 103) is connected to the recessed surface 105. One of the two sides of the second support surface 104 extending in the left-right direction 82 and positioned closer to the first support surface 103 than the other to the first support surface 103 (i.e. a front edge of the second support surface 104) is connected to the recessed surface 105. In other words, the recessed surface 105 connects the one of the two sides of the first support surface 103 to the one of the two sides of the second support surface 104. The recessed surface 105 is a curved surface having an arcuate shape as viewed in the left-right direction 82, the convex side of the arcuate shape protruding in the downward direction 53. The recessed surface 105 does not contact the protrusion 67 of the IC board 64 in a state where the IC board 64 is attached to the support portion 101, since the recessed surface 105 has a shape recessed in a direction away from the IC board 64 placed onto the first support surface 103 and the second support surface 104.

A dimension of the first support surface 103 in the left-right direction 82 and a dimension of the second support surface 104 in the left-right direction 82 are smaller than a dimension of the plate portion 66 of the IC board 64 in the left-right direction 82. A dimension of the recessed surface 105 in the left-right direction 82 is smaller than a dimension of the first support surface 103 in the left-right direction 82 and a dimension of the second support surface 104 in the left-right direction 82. With this configuration, the left end surface 66C of the plate portion 66 of the IC board 64 is positioned further outward in the leftward direction 56 than a left edge of the first support surface 103, a left edge of the second support surface 104, and a left edge of the recessed surface 105. In other words, the left end surface 66C of the plate portion 66 of the IC board 64 is positioned leftward in the leftward direction 56 relative to the left edge of the first support surface 103, the left edge of the second support surface 104, and the left edge of the recessed surface 105.

The right wall surface 106 extends in the downward direction 53 from a right edge of the recessed surface 105. The right wall surface 106 extends in the front-rear direction 81 and the vertical direction 83. The right wall surface 106 has an upper end portion in which an opening 108 is formed. The opening 108 is also defined by the right edge of the recessed surface 105. In other words, the first surface 66A of the plate portion 66 of the IC board 64 and a boundary between the recessed surface 105 and the right wall surface 106 provide the opening 108. The opening 108 is an example of an opening and an open end.

The left wall surface 107 extends in the downward direction 53 from a left edge of the first support surface 103, a left edge of the second support surface 104, and a left edge of the recessed surface 105. The left wall surface 107 extends in the front-rear direction 81 and the vertical direction 83. A part of the left wall surface 107 extending in the downward direction 53 from the left edge of the recessed surface 105 is positioned rightward in the rightward direction 55 relative to a remaining part of the left wall surface 107 extending in the downward direction 53 from the left edge of the first support surface 103 and the left edge of the second support surface 104. The left wall surface 107 has an upper end portion in which an opening 109 is formed at its center portion in the front-rear direction 81. The opening 109 is also defined by the left edge of the recessed surface 105. In other words, the first surface 66A of the plate portion 66 of the IC board 64 and a boundary between the recessed surface 105 and the left wall surface 107 provide the opening 109. The opening 109 is an example of an opening and an open end.

A space 121 is formed above the recessed surface 105 and defined by the recessed surface 105, the first surface 66A, and the protrusion 67. The space 121 is an example of a chamber. The space 121 is open in the left-right direction 82 through the opening 108 and the opening 109. That is, the opening 108 forms one end of the space 121 in the left-right direction 82, while the opening 109 forms the other end of the space 121 in the left-right direction 82. In other words, the space 121 is a through-hole extending in the left-right direction 82.

<Positioning Surfaces 122 and 123>

The support portion 101 further includes a first positioning surface 122 and a second positioning surface 123. The first positioning surface 122 and the second positioning surface 123 are an example of a positioning surface. The first positioning surface 122 extends in the upward direction 54 at a position rightward of a right edge of the first support surface 103. The second positioning surface 123 extends in the upward direction 54 at a position rightward of a right edge of the second support surface 104. The first positioning surface 122 and the second positioning surface 123 are surfaces extending in the vertical direction 83 and the front-rear direction 81. The first positioning surface 122 and the second positioning surface 123 contact the right end surface 66D of the plate portion 66 of the IC board 64 when the IC board 64 is attached to the support portion 101.

<Restricting Wall 124>

Figure 5B:
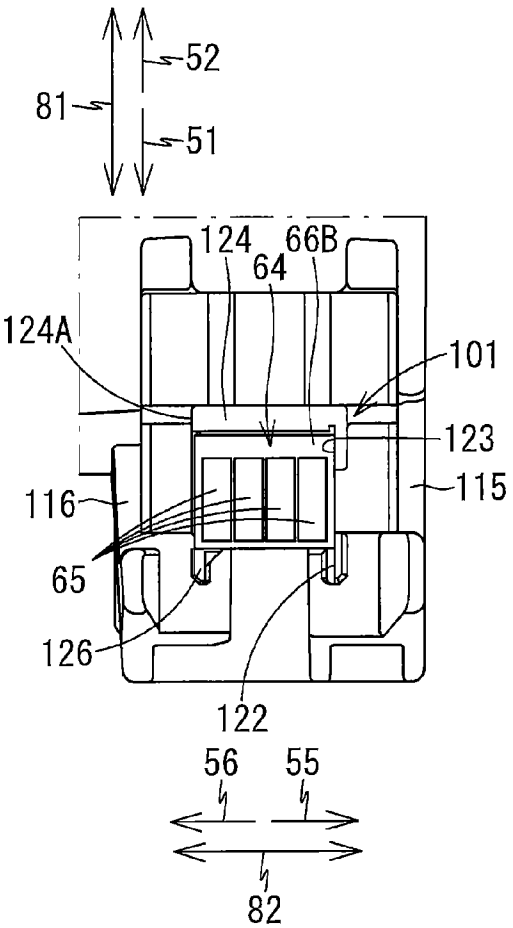
Figure 5C:
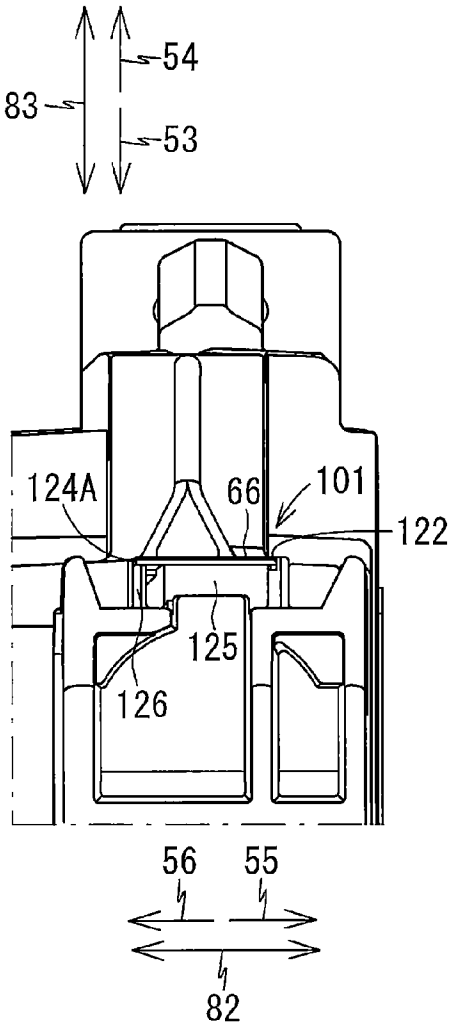

The support portion 101 further includes a restricting wall 124. The restricting wall 124 is positioned in proximity to the second support surface 104 and rearward in the rearward direction 52 relative to the second support surface 104. The restricting wall 124 has a left end portion 124A and a front end surface 124B. The left end portion 124A protrudes further outward in the leftward direction 56 than the left end surface 66C of the plate portion 66 of the IC board 64, as illustrated in FIGS. 5A and 5B. In other words, a left end surface of the left end portion 124A is positioned leftward in the leftward direction 56 relative to the left end surface 66C of the plate portion 66 of the IC board 64. The front end surface 124B extends in the vertical direction 83 and the left-right direction 82. The left end surface 124B is an example of a wall surface and a second wall surface. The left end portion 124A is an example of a protruding portion.

<Contact Surface 125>

The support portion 101 further includes a contact surface 125. The contact surface 125 extends in the downward direction 53 from a front edge 103A of the first support surface 103. The contact surface 125 extends in the vertical direction 83 and the left-right direction 82. The rear edge of the first support surface 103 is an example of a first edge and the front edge 103A of the first support surface 103 is an example of a second edge.

<Protruding Wall 126>

The support portion 101 further includes a protruding wall 126. The protruding wall 126 is positioned forward in the forward direction 51 of a left end portion of the first support surface 103. The protruding wall 126 has a flat plate shape extending in the front-rear direction 81 and the vertical direction 83. A left end surface of the protruding wall 126 is positioned further outward in the leftward direction 56 than the left end surface 66C of the plate portion 66 of the IC board 64, as illustrated in FIG. 5B. In other words, the left end surface of the protruding wall 126 is positioned leftward in the leftward direction 56 relative to the left end surface 66C of the plate portion 66 of the IC board 64. The protruding wall 126 is an example of a protruding portion.

<Attachment Method of IC Board 64>

Next, a method for attaching the IC board 64 to the support portion 101 will be described with reference to the flowchart in FIG. 6.

The IC board 64 is fixed to the support portion 101 by the adhesive agent 102, such as a photocurable adhesive agent. The photocurable adhesive agent is a type of adhesive agent that can cure (harden) upon exposure to ultraviolet light. Here, the method for attaching the IC board 64 to the support portion 101 will be described assuming that the IC board 64 is fixed to the support portion 101 using the photocurable adhesive agent as the adhesive agent 102 and an attachment operation for attaching the IC board 64 to the support portion 101 is performed by a person (hereinafter referred to as an operator). Note that the attachment operation for attaching the IC board 64 to the support portion 101 may be performed by a device. The adhesive agent 102 is an example of an adhesive agent and a photocurable adhesive agent.

Figure 6:
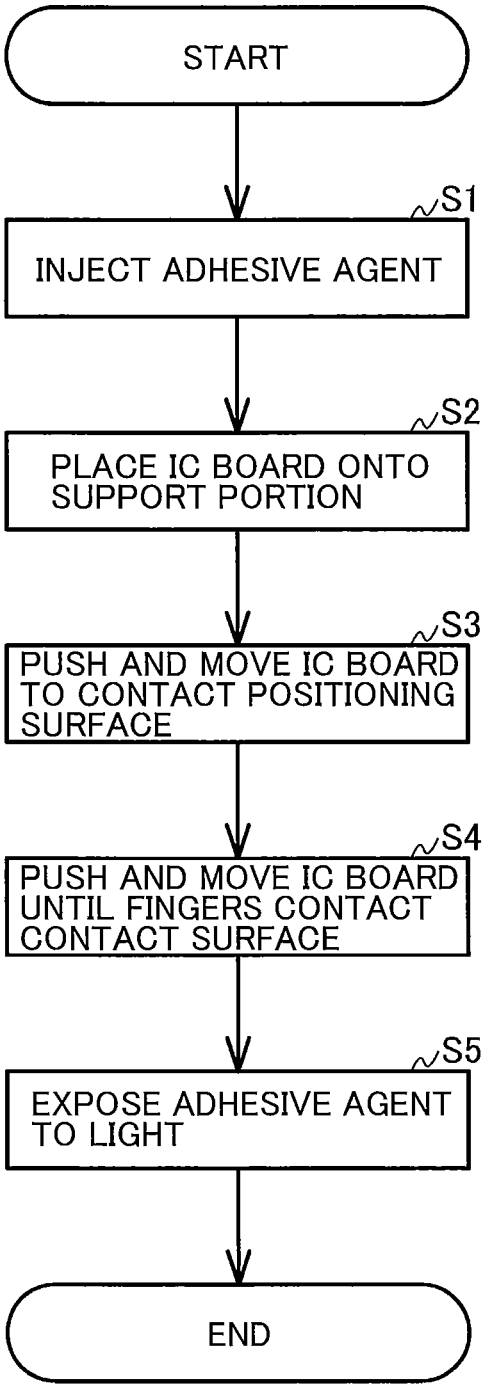
FIG. 6 is a flowchart illustrating steps in a process for attaching the IC board 64 to the support portion 101 by using an adhesive agent.

As illustrated in FIG. 6, in order to attach the IC board 64 to the support portion 101 using the adhesive agent 102 (i.e. photocurable adhesive agent), the operator first injects the adhesive agent 102 onto the recessed surface 105 (S1).

Then, the operator places the IC board 64 onto the support portion 101 such that the protrusion 67 of the IC board 64 is disposed above the recessed surface 105 of the support portion 101 and that the first surface 66A of the plate portion 66 of the IC board 64 faces and contacts the first support surface 103 and the second support surface 104 (S2). Hence, the first surface 66A is supported by the first support surface 103 and the second support surface 104. By placing the IC board 64 onto the support portion 101, the space 121 formed above the recessed surface 105 and defined by the recessed surface 105, the first surface 66A, and the protrusion 67 is filled with the adhesive agent 102. Note that, at this time, the space 121 may not be fully occupied by the adhesive agent 102. As long as the IC board 64 can be fixed to the support portion 101, the space 121 is not necessarily filled up with the adhesive agent 102.

Next, the operator pushes the IC board 64 in the rightward direction 55 to move the IC board 64 toward the first positioning surface 122 and the second positioning surface 123 by his/her finger(s) or a tool until the right end surface 66D of the plate portion 66 of the IC board 64 contacts the first positioning surface 122 and the second positioning surface 123 (S3).

At this time, if the front end surface 66E of the plate portion 66 of the IC board 64 is positioned further forward in the forward direction 51 than the contact surface 125 of the support portion 101, that is, if the front end surface 66E is positioned offset from the contact surface 125 in the forward direction 51, the operator pushes the front end surface 66E of the IC board 64 to move the IC board 64 in the rearward direction 52 by his/her finger(s) or the tool (S4). In this case, the operator pushes and moves the IC board 64 until his/her finger(s) or the tool contacts the contact surface 125. Accordingly, the IC board 64 is pushed and moved until the front end surface 66E is aligned with the contact surface 125 as viewed in the vertical direction 83.

At this time, even if the IC board 64 is excessively pushed in the rearward direction 52, the rear end surface 66F of the plate portion 66 of the IC board 64 contacts the front end surface 124B of the restricting wall 124. Accordingly, excessive movement of the IC board 64 in the rearward direction 52 can be restrained.

Subsequently, the adhesive agent 102 on the recessed surface 105 is exposed to light, such as ultraviolet light, through the notch 116 and the opening 109 from a left side relative to the notch 116 and the opening 109 in the left-right direction 82 as well as through the notch 115 and the opening 108 from a right side relative to the notch 115 and the opening 108 in the left-right direction 82 (S5). Upon exposure to light, the adhesive agent 102 cures. Hence, the IC board 64 is bonded to the support portion 101 with the adhesive agent 102.

The end portion of the first protruding portion 85 in the leftward direction 56 is formed with the notch 116 that overlaps the opening 109 as viewed in the rightward direction 55, and the end portion of the first protruding portion 85 in the rightward direction 55 is formed with the notch 115 that overlaps the opening 108 as viewed in the leftward direction 56. Hence, the adhesive agent 102 can be easily exposed to light. Further, the adhesive agent 102 is exposed to light from both the left and right sides in the left-right direction 82. This arrangement can prevent light from being blocked by the protrusion 67 of the IC board 64. Accordingly, the adhesive agent 102 in its entirety can be easily exposed to light.

<Operational Advantages of Embodiment>

According to the above-described embodiment, the space 121 formed above the recessed surface 105 is exposed to an outside in the left-right direction 82. With this configuration, the adhesive agent 102 provided in the space 121 formed above the recessed surface 105 can easily cure by exposure to light from left and right sides of the space 121 in the left-right direction 82.

Compared to a case where an IC board is bonded to a support portion by spot application of an adhesive agent, a bonding area between the IC board 64 and the support portion 101 can be increased. Hence, strength of adhesive bonding between the IC board 64 and the support portion 101 can be increased.

Further, the adhesive agent 102 is provided in the space 121 formed above the recessed surface 105. Hence, the adhesive agent 102 can be restrained from overflowing the IC board 64.

Further, compared to a case where an IC board is force-fitted to a support portion or is attached to a support portion by a double-stick tape, a spatial area required for attaching the IC board 64 to the support portion 101 by the adhesive agent 102 can be reduced. Thus, the ink cartridge 30 can be made more compact.

The recessed surface 105 is a curved surface that curves in the front-rear direction 81. That is, the recessed surface 105 has an arcuate shape as viewed in the left-right direction 82. Compared to a case where a recessed surface has a flat bottom surface, the space 121 formed above the recessed surface 105 can be made smaller in volume. Hence, the space 121 formed above the recessed surface 105 requires less adhesive agent 102 to be filled therein.

The protrusion 67 of the IC board 64 is formed of an epoxy resin. The adhesive agent 102 is an acrylic-type adhesive agent. The epoxy resin exhibits good adhesive properties relative to the acrylic-type adhesive agent. Hence, the IC board 64 can be firmly fixed to the support portion 101.

The right end surface 66D of the plate portion 66 in the left-right direction 82 of the IC board 64 contacts the first positioning surface 122 and the second positioning surface 123, so that the IC board 64 is fixed in position in the left-right direction 82. The operator can easily fix the IC board 64 in position in the left-right direction 82.

In a state where the right end surface 66D of the plate portion 66 of the IC board 64 is in contact with the first positioning surface 122 and the second positioning surface 123, the left end surface 66C of the plate portion 66 in the left-right direction 82 of the IC board 64 is positioned further leftward in the leftward direction 56 than the left edges of the first support surface 103 and the second support surface 104. With this configuration, the IC board 64 can be easily removed from the support portion 101 when the IC board 64 is collected for the purpose of recycling, for example.

The left end portion 124A of the restricting wall 124 and the protruding wall 126 suppress contact of user's finger(s) or a tool with the left end surface 66C of the plate portion 66 of the IC board 64. Accordingly, undesired removal of the IC board 64 from the support portion 101 can be prevented.

The front end surface 124B of the restricting wall 124 restricts movement of the IC board 64 placed on the first support surface 103 and the second support surface 104 when the IC board 64 moves along the first support surface 103 and the second support surface 104 in the rearward direction 52 and is about to pass over the restricting wall 124. Hence, when the IC board 64 is excessively pushed toward the restricting wall 124 during a process of positioning the IC board 64 on the first support surface 103 and the second support surface 104, the front end surface 124B prevents excessive movement of the IC board 64 toward the restricting wall 124.

In order to fix the IC board 64 in position on the first support surface 103 and the second support surface 104, the IC board 64 is pushed in the front-rear direction 81 by using a finger(s) of the operator or a tool. At this time, the finger(s) or the tool contacts the contact surface 125 when the IC board 64 reaches a proper position on the first support surface 103 and the second support surface 104. This configuration prevents the IC board 64 from being excessively pushed in the front-rear direction 81.

The notch 115 and the notch 116 are formed in the first protruding portion 85 at positions that overlap the opening 108 and the opening 109, respectively, as viewed in the left-right direction 82. With this configuration, the opening 108 and the opening 109 are exposed to an outside of the first protruding portion 85. Hence, light can easily enter the space 121 through the opening 108 and the notch 115 and through the opening 109 and the notch 116 from an outside of the front cover 32.

<Modifications>

In the above-described embodiment, a photocurable adhesive agent is used as the adhesive agent 102. However, a drying adhesive agent may be used as the adhesive agent 102. In case the drying adhesive agent is used as the adhesive agent 102, the adhesive agent 102 can be easily dried since the space 121 formed above the recessed surface 105 is open in the left-right direction 82 to allow air to pass therethrough sufficiently.

Further, in the above-described embodiment, the space 121 formed above the recessed surface 105 is open in the left-right direction 82. However, the space 121 formed above the recessed surface 105 may be open in the front-rear direction 81, for example.

While the description has been made in detail with reference to the embodiment thereof, it would be apparent to those skilled in the art that various changes and modifications may be made therein without departing from the spirit of the disclosure.

What is claimed is:

1. A liquid cartridge comprising:

a storage element comprising:

a substrate having a first surface; and a protrusion protruding from the first surface;

an adhesive agent; and a cartridge body at which the storage element is disposed, the cartridge body comprising a support portion supporting the storage element, the support portion having:

a first support surface in contact with the first surface and supporting the first surface;

a second support surface in contact with the first surface and supporting the first surface; and a recessed surface positioned between the first support surface and the second support surface in a first direction, the recessed surface, the first surface, and the protrusion defining a chamber configured to store the adhesive agent to fix the protrusion of the storage element to the recessed surface, the chamber being exposed to an outside through an opening in a second direction perpendicular to the first direction and parallel to the first support surface.

2. The liquid cartridge according to claim 1, wherein the recessed surface is a curved surface having an arcuate shape as viewed in the second direction.

3. The liquid cartridge according to claim 1, wherein the protrusion has an outer surface portion formed of an epoxy resin, and wherein the adhesive agent is an acrylic-type adhesive agent.

4. The liquid cartridge according to claim 1, wherein the substrate of the storage element has a second surface opposite to the first surface, and a first end surface perpendicular to the second direction, wherein the storage element further includes a plurality of electrical contacts disposed on the second surface and arrayed in the second direction, and wherein the support portion further has a positioning surface perpendicular to the second direction, the positioning surface being in contact with the first end surface.

5. The liquid cartridge according to claim 4, wherein the substrate of the storage element has a second end surface opposite to the positioning surface with respect to the first end surface in the second direction, and wherein the second end surface is positioned further outward in the second direction than at least one of the first support surface and the second support surface.

6. The liquid cartridge according to claim 5, wherein the support portion further has a protruding portion protruding further outward in the second direction than the second end surface.

7. The liquid cartridge according to claim 1, wherein the support portion further has a wall surface perpendicular to the first direction and positioned in proximity to one of the first support surface and the second support surface, the wall surface extending farther than the one of the first support surface and the second support surface in a third direction perpendicular to the first direction and the first support surface.

8. The liquid cartridge according to claim 7, wherein the other of the first support surface and the second support surface has a first edge extending in the second direction and a second edge extending in the second direction, the second edge being positioned farther from the recessed surface than the first edge from the recessed surface, and wherein the support portion further has a contact surface extending from the second edge in a direction opposite to the third direction.

9. The liquid cartridge according to claim 1, wherein the cartridge body has a notch at a position overlapping the opening when viewed in the second direction, the opening being exposed to an outside through the notch.

10. The liquid cartridge according to claim 1, wherein the cartridge body includes a liquid supply portion configured to allow liquid stored in an interior of the cartridge body to flow out of the cartridge body, the opening facing in a direction crossing a direction in which the liquid supply portion extends.

11. The liquid cartridge according to claim 1, wherein the adhesive agent is a photocurable adhesive agent.

12. The liquid cartridge according to claim 1, wherein the chamber is a through-hole extending in the second direction, the opening being one end of the through-hole in the second direction, the through-hole being exposed to an outside through the opening.

13. The liquid cartridge according to claim 1, wherein the opening is positioned between the first support surface and the second support surface in the first direction.

14. The liquid cartridge according to claim 1, wherein a dimension of the recessed surface in the second direction is smaller than a dimension of the first support surface in the second direction, the dimension of the recessed surface in the second direction is smaller than a dimension of the second support surface in the second direction.

15. The liquid cartridge according to claim 1, wherein the opening is defined by the recessed surface and the first surface.

16. A method for manufacturing a liquid cartridge including: a storage element, a cartridge body, and a photocurable adhesive agent for fixing the storage element to the cartridge body, the storage element including:

a substrate having a first surface; and a protrusion protruding from the first surface, the cartridge body including a support portion for supporting the storage element, the support portion having:

a first support surface;

a second support surface spaced apart from the first support surface in a first direction;

a recessed surface positioned between the first support surface and the second support surface in the first direction; and a first wall surface positioned beside the recessed surface in a second direction perpendicular to the first direction and parallel to the first support surface, the method comprising:

injecting the photocurable adhesive agent onto the recessed surface;

placing the storage element on the support portion such that:

the first surface is in contact with the first support surface and the second support surface;

the protrusion faces the recessed surface, a space being defined by the recessed surface, the first surface, and the protrusion, the space having an open end in the second direction opened at the first wall surface; and the photocurable adhesive agent is provided in the space; and exposing the photocurable adhesive agent that has been applied to the recessed surface and provided in the space to light in the second direction through the open end.

17. The method for manufacturing a liquid cartridge according to claim 16, wherein the substrate further has: a first end surface perpendicular to the second direction; a second end surface perpendicular to the second direction; a third end surface perpendicular to the first direction; and a fourth end surface perpendicular to the first direction, one of the first support surface and the second support surface having a first edge extending in the second direction and a second edge extending in the second direction, the second edge being positioned farther from the recessed surface than the first edge from the recessed surface, the support portion further having a positioning surface and a contact surface, the positioning surface being perpendicular to the second direction, the first end surface being positioned closer to the positioning surface than the second end surface to the positioning surface in the second direction, the contact surface extending from the second edge in a direction from the first surface to the first support surface and parallel to a third direction perpendicular to the first direction and the first support surface, the third end surface being positioned closer to the contact surface than the fourth end surface to the contact surface in the first direction, the method further comprising:

after the placing, pushing the storage element in the second direction to move the storage element toward the positioning surface until the first end surface of the substrate of the storage element contacts the positioning surface; and pushing the storage element in the first direction to move the storage element to a position where the third end surface of the substrate of the storage element is aligned with the contact surface in the first direction provided that the third end surface is positioned opposite to the recessed surface with respect to the contact surface in the first direction and offset from the contact surface in the first direction.

18. A method for manufacturing a liquid cartridge comprising:

preparing a storage element and a cartridge body, the storage element comprising:

a substrate having a first surface; and a protrusion protruding from the first surface, the cartridge body comprising a support portion for supporting the storage element, the support portion having:

a first support surface;

a second support surface spaced apart from the first support surface in a first direction;

a recessed surface positioned between the first support surface and the second support surface in the first direction; and a first wall surface positioned beside the recessed surface in a second direction perpendicular to the first direction and parallel to the first support surface;

injecting a photocurable adhesive agent onto the recessed surface;

placing the storage element on the support portion such that:

the first surface is in contact with the first support surface and the second support surface;

the protrusion faces the recessed surface, a space being defined by the recessed surface, the first surface, and the protrusion, the space having an open end in the second direction opened at the first wall surface; and the photocurable adhesive agent is provided in the space; and exposing the photocurable adhesive agent that has been applied to the recessed surface and provided in the space to light in the second direction through the open end.

19. The method for manufacturing a liquid cartridge according to claim 18, wherein, when the preparing, the substrate further has: a first end surface perpendicular to the second direction; a second end surface perpendicular to the second direction; a third end surface perpendicular to the first direction; and a fourth end surface perpendicular to the first direction, one of the first support surface and the second support surface having a first edge extending in the second direction and a second edge extending in the second direction, the second edge being positioned farther from the recessed surface than the first edge from the recessed surface, the support portion further having a positioning surface and a contact surface, the positioning surface being perpendicular to the second direction, the first end surface being positioned closer to the positioning surface than the second end surface to the positioning surface in the second direction, the contact surface extending from the second edge in a direction from the first surface to the first support surface and parallel to a third direction perpendicular to the first direction and the first support surface, the third end surface being positioned closer to the contact surface than the fourth end surface to the contact surface in the first direction, the method further comprising:

after the placing, pushing the storage element in the second direction to move the storage element toward the positioning surface until the first end surface of the substrate of the storage element contacts the positioning surface; and pushing the storage element in the first direction to move the storage element to a position where the third end surface of the substrate of the storage element is aligned with the contact surface in the first direction provided that the third end surface is positioned opposite to the recessed surface with respect to the contact surface in the first direction and offset from the contact surface in the first direction.

* * * * *